US006400235B1

(12) United States Patent
Perez

(10) Patent No.: US 6,400,235 B1
(45) Date of Patent: Jun. 4, 2002

(54) RADIO FREQUENCY, MILLIMETER-WAVE OR MICROWAVE DEVICE AND METHOD OF MAKING SAME

(75) Inventor: Henry Perez, Wading River, NY (US)

(73) Assignee: L3 Communications Corporation, New York, NY (US)

( * ) Notice: Subject to any disclaimer, the term of this patent is extended or adjusted under 35 U.S.C. 154(b) by 0 days.

(21) Appl. No.: 09/378,374

(22) Filed: Aug. 20, 1999

(51) Int. Cl.[7] ..... H01P 5/12; H01P 5/18; H01P 3/06

(52) U.S. Cl. ..... 333/113; 333/244

(58) Field of Search ..... 333/109, 113, 333/140, 244, 115, 243, 245, 100; 174/254, 28

(56) References Cited

U.S. PATENT DOCUMENTS 2,452,948 A * 11/1948 Morin ..... 333/244

5,072,201 A * 12/1991 Devaux et al. ..... 333/238

* cited by examiner

*Primary Examiner*—Robert Pascal
*Assistant Examiner*—Kimberly E. Glenn
(74) *Attorney, Agent, or Firm*—Hoffman & Baron, LLP

(57) ABSTRACT

A coupler includes one or more conductors and a support structure for the conductors within the coupler. The conductors are inserted through oblong holes in the support structure while the support structure is in an assembling position. When the support structure is tilted from the assembling position to a securing position, which is in a direction away from normal to a longitudinal axis of the conductors, the external surfaces of the conductors are engaged by the support structure at the oblong holes. Typically, a removable cover of the coupler exerts a downward force, which deflects opposite outer edges of the support structure to maintain the support structure in the securing position. The spacing between the conductors is maintained substantially constant over time, temperature, and handling while the support structure is in the securing position.

8 Claims, 4 Drawing Sheets

RADIO FREQUENCY, MILLIMETER-WAVE OR MICROWAVE DEVICE AND METHOD OF MAKING SAME

BACKGROUND OF THE INVENTION

1. Field of the Invention

This invention relates to radio frequency, millimeter-wave and microwave devices, and more specifically relates to a support structure, which maintains the relative spacing between conductors in such devices.

2. Description of the Prior Art

Radio frequency, millimeter-wave and microwave devices typically include one or more conductors internal to the device. The relative spacing and orientation of the conductors are often essential in maintaining a desired set of performance characteristics and design specifications for these devices. This is the case with microwave devices such as couplers, dividers, combiners and hybrids in which the relative distances between two or more conductors must be maintained to ensure that circuit characteristics are substantially constant over time, temperature, and handling.

Couplers can be used for such purposes as matching impedances or enabling two or more signals in different frequency bands to share a common transmission line. The latter type of coupler is commonly referred to in the art as a "cross-band coupler". The cross-band coupler typically includes an enclosure, which houses separate conductors for the signals in the two bands, and a common conductor in which the signals from the two bands are alternately induced. Connectors mounted on an external surface of the enclosure provide a channel for the signals to pass from external cabling to the conductors inside the enclosure. The internal conductors are typically manufactured from copper rod.

Conventional methods of fixing the distance between conductors in a coupler involve the use of dielectric blocks. The dielectric blocks are milled or trimmed to a desired size, and a hole is drilled through the dielectric blocks which is about the size of the external circumference of the conductor. The dielectric blocks are then slid over the conductors, and the distance between adjacent conductors is adjusted or gapped to an appropriate value according to the coupling characteristics desired. Once the desired distance between the conductors is achieved, the blocks are affixed with adhesive to an internal surface of the enclosure.

The conventional method of spacing conductors just described presents many problems including losses and undesirable coupling though the dielectric blocks between the conductors, as well as between the conductors and the enclosure. In addition, gapping each coupler to achieve the desired spacing between the conductors is a difficult, costly, and time consuming task. Further, the dielectric, adhesive, or both typically move or change in dimension over time and temperature, which directly affects the performance characteristics of the coupler.

OBJECTS AND SUMMARY OF THE INVENTION

It is an object of the present invention to provide a radio frequency, millimeter-wave or microwave device and a method of making such a device, in which losses from and coupling between conductors internal to the device caused by a support structure for the conductors are negligible.

It is yet another object of the present invention to provide a support structure for conductors internal to radio frequency, millimeter-wave or microwave devices and a method of making such a device, which facilitates the manufacturing process of these devices, and enables these devices to maintain a substantially constant orientation of and spacing between the internal conductors regardless of aging, temperature, and handling.

It is yet a further object of the present invention to provide a coupler having at least a pair of spaced-apart conductors and a structure to support and maintain the spacing between them.

In accordance with one form of the present invention, a radio frequency, millimeter-wave or microwave device includes one or more internal conductors, and a support structure for the conductors. The support structure is preferably formed as a thin insulating sheet having oblong or oval-shaped holes cut through its thickness. The size of the holes and the spacing between adjacent holes in the sheet are selected to allow the conductors to be received by the holes and spaced apart a predetermined distance from each other.

The device includes a housing or enclosure in which the insulating sheet support structure and the conductors are situated. Preferably, the housing includes a base that is integral with four sidewalls and a removable cover, which define an interior cavity for housing the conductors and the support structure.

The insulating sheet support structure has a width such that the sheet extends partially above the top of the four sidewalls at an angle away from normal to the base when the conductors are disposed within the support structure. As the cover is mounted and secured on the four sidewalls of the device, it exerts a slight pressure on the edge of the insulating sheet, deflecting it slightly and holding the sheet in place within the cavity. The insulating sheet, in turn, secures the conductors in place within the housing and maintains the relative spacing between the conductors.

In accordance with another form of the present invention, a method of making a radio frequency, millimeter-wave or microwave device includes the steps of passing conductors through oblong holes in the support structure while the support structure is in an assembly position. The conductors are freely slidable within the holes while the support structure is in the assembly position. The support structure is then tilted away from the assembly position to a securing position, which is offset from normal to a longitudinal axis of the conductors. A force is then exerted on the support structure to maintain them in the securing position, which causes the external surfaces of the conductors to engage with the edges of the holes. Once in the securing position, the support structure maintains the relative spacing between the conductors within the enclosure.

These and other objects, features and advantages of the present invention will become apparent from the following detailed description of illustrative embodiments thereof, which is to be read in conjunction with the accompanying drawings.

DETAILED DESCRIPTION OF THE PREFERRED EMBODIMENTS

A coupler is just one example of a radio frequency millimeter-wave or microwave device in which spacing between conductors internal to the device is important and to which the present invention is applicable. Conventional couplers typically have an enclosure with a removable cover and four sidewalls integral with a base cut out of a block of metal, such as aluminum. Two or more conductors are routed within the enclosure, and connect to external signals via connectors mounted on an external surface of the enclosure. The spacing between the conductors is critical in maintaining predetermined coupling characteristics over time, temperature, and handling.

Figure 1:
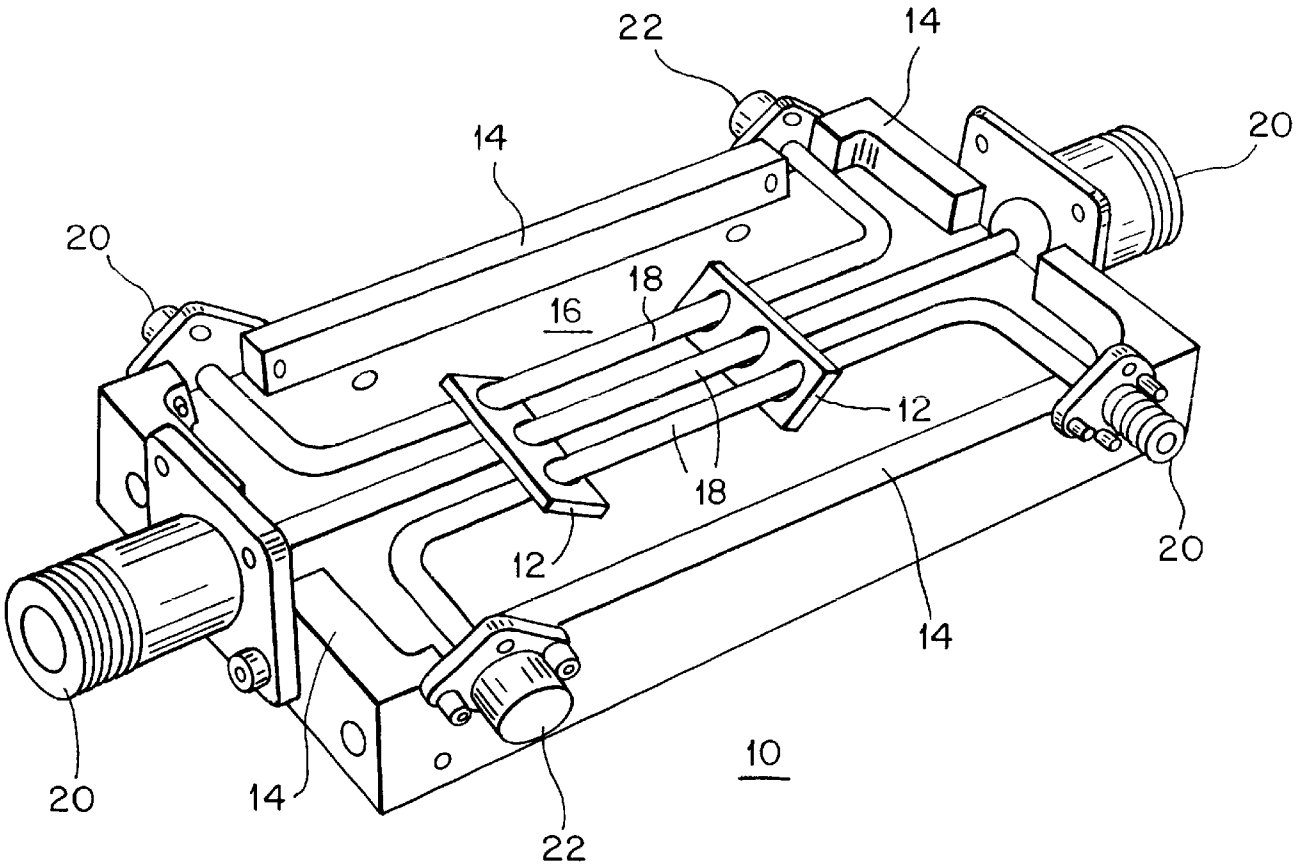
FIG. 1 is a top perspective view of a coupler without a cover showing a pair of support structures formed in accordance with the present invention.

FIG. 1 shows a top perspective view of a coupler 10 without a cover. Two support structures 12 formed in accordance with the present invention are disposed around the conductors 18. The enclosure includes four sidewalls 14 integral with the base 16. The conductors 18 are disposed within a cavity formed by the four sidewalls 14 and base 16. The conductors 18 are routed between external connectors 20 and/or terminations 22 mounted on the external surface of the enclosure. The conductors 18 are preferably formed from lengths of copper rod.

The support structures 12 are preferably manufactured as substantially flat sheets of insulating material with oblong or oval-shaped holes cut through the thickness of the support structures 12. The conductors 18 are preferably cut and formed to an appropriate length and shape. The conductors 18 are then inserted through the holes in the support structures 12 while the support structures 12 are in an assembling position shown in FIG. 3A. Once the conductors 18 are disposed within the oblong holes of the support structures 12, and the support structures 12 are tilted away from the assembling position to a securing position shown in FIG. 3B, the support structures 12 maintain the relative spacing between and orientation of the conductors 18 within the coupler 10. Constant spacing between the conductors 18 regardless of time, temperature, and handling is essential to maintaining coupling characteristics, such as frequency response, rise and fall times, overshoot, undershoot, ringing and the like.

Figure 4A:
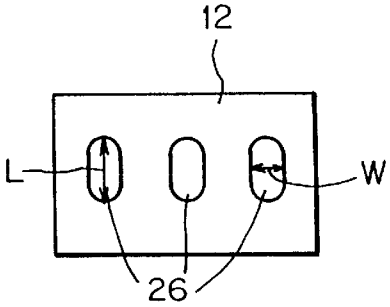
FIGS. 4A, 4B, 4C, 4D, and 4E are pictorial representations of alternative embodiments of the support structure formed in accordance with the present invention.

The term "oblong" is defined as having a width W or minor axis which is shorter than a length L or major axis. The hole 26 may be rectangular, elliptical, oblong or oval. FIG. 4A shows that the width W of the oblong holes 26 is preferably shorter than the length L.

Figure 2:
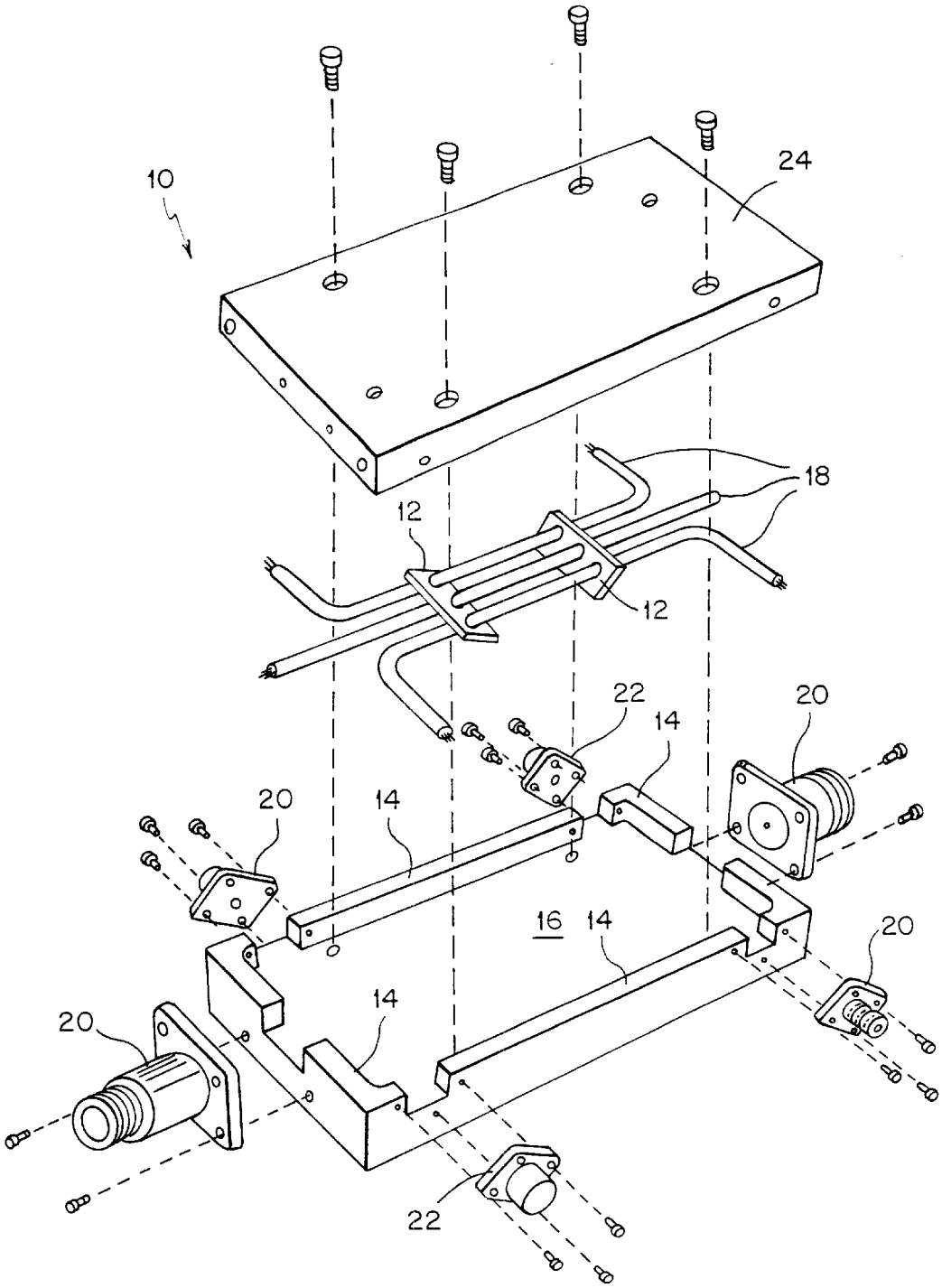
FIG. 2 is a partially-exploded perspective view of the coupler shown in FIG. 1 with the cover removed showing the support structures formed in accordance with the present invention.

FIG. 2 shows a top partially-exploded perspective view of the coupler 10 with the cover 24 removed. The cover 24 is preferably formed from solid metal, such as aluminum, and fits over the four side walls 14 and base 16 to enclose the conductors 18 and support structures 12 disposed within the cavity. As the cover 24 comes into contact with the four sidewalls 14, the cover 24 exerts a downward, compressing force on the support structures 12. The force functions to secure the conductors 18 within the oblong holes of the support structures 12.

Figure 3B:
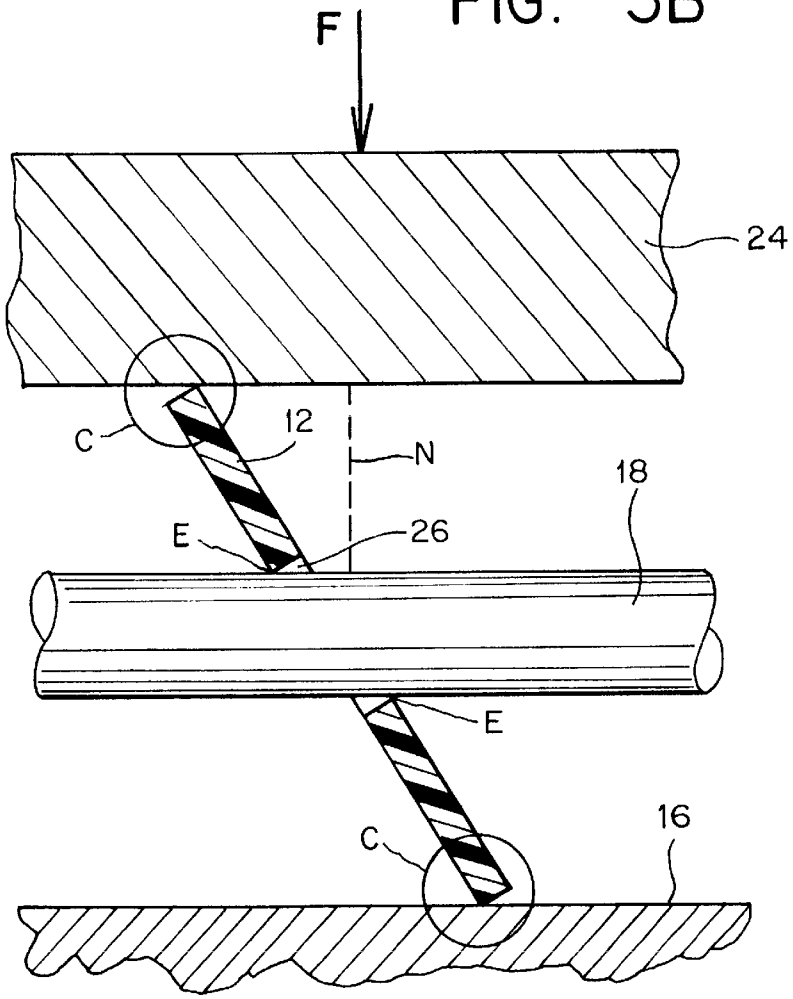
FIG. 3B is a side cross-sectional view of the support structure formed in accordance with the present invention while in a securing position.
Figure 3A:
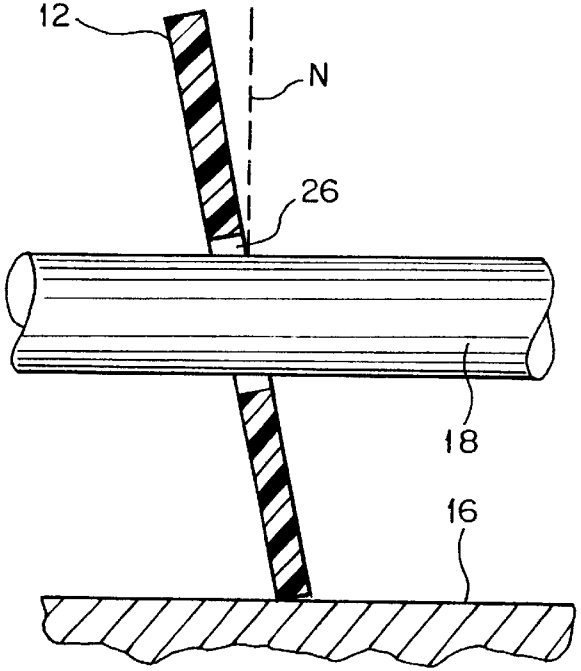
FIG. 3A is a side cross-sectional view of the support structure formed in accordance with the present invention while in an assembly position.

FIG. 3A shows a side cross-sectional view of the support structure 12 having one of the conductors 18 disposed within one of the oblong holes 26 of the support structure 12 while the support structure 12 is in the assembling position. While in the assembling position, the support structure 12 permits the conductor 18 to slide freely within the oblong hole 26. The assembling position is used to position the conductors 18 within the support structure 12 during initial assembly of the coupler 10.

FIG. 3B shows a side cross-sectional view of the support structure 12 in the securing position. The securing position is achieved by adjusting an angle of the support structure 12 away from a position normal (as shown by dotted line N) to a longitudinal axis of the conductor 18. As the support structure 12 is adjusted away from the assembling position to the securing position, an external surface of the conductor 18 is brought into contact with and engaged by opposite edges of the oblong hole 26 of the support structure 12 as shown, for example, at points E. The action of the cover 24 coming into contact with the four sidewalls 14 and exerting a force generally in the direction of the base 16 indicated by arrow F, urges the support structure 12 towards the securing position. Once in the securing position, the support structure 12 maintains the relative orientation of and spacing between the conductors 18 within the enclosure.

The dimensions of the support structure 12, the oblong holes 26, and the conductors 18 are chosen such that opposite outer peripheral edges of the support structures 12 are slightly deformed or deflected, as shown generally within circles C in FIG. 3B, when the cover 24 is secured to the four sidewalls 14 of the enclosure and engages the support structures 12. This deflection functions to maintain the support structure 12 in the securing position, and engages the edges of the oblong holes 26 with the external surface of the conductors 18. Although FIGS. 3A and 3B show the support structure 12 moving from the assembling position to the securing position in a generally counter-clockwise rotation (when viewing FIGS. 3A and 3B), the same can be accomplished in a generally clockwise rotation from the assembling position to the securing position. It is important to note that angular displacement between the assembling and securing positions can be negligible or even zero as long as the conductors 18 can be inserted in the assembling position, and the relative spacing between the conductors 18 is maintained in the securing position.

Figure 4B:
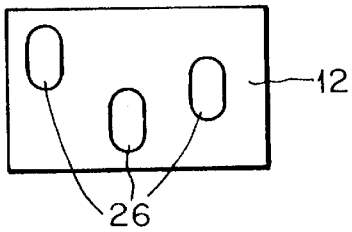
Figure 4C:
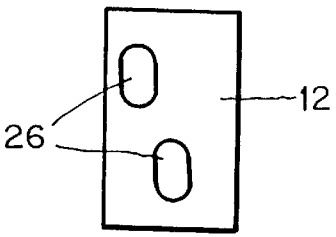
Figure 4D:
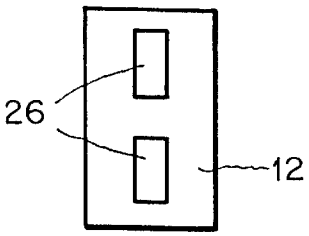
Figure 4E:
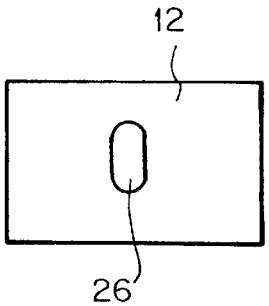

FIGS. 4A–E show alternative embodiments of the support structure 12 having various shapes and configurations of oblong holes 26. FIG. 4A shows the support structure 12 used in the couplers shown in FIGS. 1 and 2, i.e., they have spaced apart oblong holes 26 arranged side-by-side, all at the same height (in horizontal alignment). FIG. 4D depicts the oblong holes 26 as being rectangular, which can preferably be used for conductors having a square or rectangular cross-section. Also, the holes 26 are shown in FIG. 4D as being positioned in spaced apart, vertical alignment with one another. The support structure 12 shown in FIG. 4E can be used to support and maintain the position of one conductor relative to the enclosure or another element of the coupler. FIG. 4B shows the oblong holes 26 being vertically displaced by a variety of distances from horizontal alignment with each other as shown in FIG. 4A. FIG. 4C shows the oblong holes 26 being horizontally displaced from vertical alignment with each other as shown in FIG. 4D.

The support structure 12 is preferably manufactured from a substantially flat sheet of MYLAR™, plastic, dielectric insulating material, TEFLON™, DELRIN™, ULTEM™, polyethylene, polypropylene, polyurethane or the like, which does not appreciably contribute to losses or coupling from or between the conductors and the enclosure while retaining substantially constant dimensions over time, temperature, and handling. The embodiments shown in FIGS. 4A–E are intended to be illustrative rather than limiting, and show that substantially any quantity, position, and orientation of oblong holes 26 on the support structure 12 is possible while remaining within the scope of the present invention.

Preferably, the support structures 12 are formed with holes 26 whose widths W are dimensioned to be equal to or just slightly greater than the diameter of the conductors in order to closely receive the conductors and to prevent lateral movement of the conductors when the conductors are positioned in a side-by-side arrangement such as shown in FIG. 1. However, the lengths of the holes 26 are preferably larger than the diameters of the conductors they receive to allow the support structures 12 to rest at preferably an angle to the conductors other than 90°. This off-angle disposition of the support structure allows the support structure to deflect further and exert a holding force on the conductors at the oblong or longer ends of holes 26 when the cover 24 is secured to the sidewalls 14 of coupler 10.

While the present invention is illustrated using the coupler 10 as an example, it is envisioned that the support structure 12 formed in accordance with the present invention may be used in alternative devices in which the distance between, support for, or orientation of conductors is important. Such devices include but are not limited to circulators, splitters, waveguides, terminations, attenuators, and other radio frequency, millimeter-wave and microwave devices.

Thus, the method and apparatus of the present invention provide a radio frequency, millimeter-wave or microwave device, in which support structures for conductors internal to the device do not substantially contribute to losses from the conductors and coupling between the conductors and other elements of the device. In addition, the support structures maintain a substantially constant support for, orientation of, and spacing between conductors regardless of aging, temperature, and handling. Further, the support structures facilitate the manufacturing process by being relatively simple to apply during the initial assembly of the device. No adhesive is required to secure the support structures in the coupler 10 or other device; the support structures remain in position within the cavity of the device due to its compression between the cover and the base. No gapping or adjustment of the conductors is required; the holes 26 are spaced apart a predetermined distance to maintain a selected spacing between adjacent conductors when the conductors are inserted through the holes. Accordingly, many of the assembly steps (and concomitant inaccuracies in the positioning of the conductors) required with conventional couplers and like devices are eliminated with the present invention.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A radio frequency, millimeter-wave or microwave device, which comprises:

an enclosure;

at least one support structure, the at least one support structure being disposed within the enclosure, the at least one support structure having at least two oblong holes formed though the thickness thereof, the at least two oblong holes being spaced apart from each other by a predetermined distance; and at least two conductors, the at least two conductors being disposed within the enclosure, each conductor of the at least two conductors being received by a respective oblong hole of the at least two oblong holes of the at least one support structure, the at least one support structure securing the at least two conductors in place within the enclosure and maintaining a spacing between the at least two conductors.

2. A radio frequency, millimeter-wave or microwave device, which comprises:

an enclosure;

at least one support structure, the at least one support structure being disposed within the enclosure, the at least one support structure being positionable in an assembling position and a securing position, the at least one support structure having formed through the thickness thereof at least one oblong hole, the at least one oblong hole being defined by a major axis and a minor axis disposed perpendicularly to the major axis, the at least one oblong hole being formed with a greater length along the major axis than along the minor axis, the at least one support structure having opposite inner edges defining the length of the at least one oblong hole along the major axis; and at least one conductor, the at least one conductor being disposed within the enclosure, the at least one conductor having a longitudinal axis and an external surface, the at least one conductor being received by the at least one oblong hole of the at least one support structure while the at least one support structure is in the assembling position, the at least one support structure being disposed at an angle greater than 0 degrees from a normal to the longitudinal axis of the at least one conductor when the at least one support structure is in the securing position, the external surface of the at least one conductor being engaged by the opposite inner edges of the at least one support structure defining the at least one oblong hole when the at least one support structure is in the securing position, the opposite inner edges of the at least one support structure exerting a holding force on the at least one conductor thereby maintaining the position of the at least one conductor within the enclosure when the at least one support structure is in the securing position.

3. A method of making a radio frequency, millimeter-wave or microwave device, which comprises the steps of:

inserting at least one conductor through at least one oblong hole formed through the thickness of at least one support structure while the at least one support structure is in an assembling position, the at least one conductor being slidably receivable by the at least one oblong hole while the at least one support structure is in the assembling position;

placing into an enclosure the at least one support structure and the at least one conductor positioned in the at least one oblong hole of the at least one support structure; and repositioning the at least one support structure from the assembling position to a securing position by exerting a force thereon, the at least one conductor having a longitudinal axis and an external surface, the at least one support structure being at an angle greater than a normal to the longitudinal axis of the at least one conductor when the at least one support structure is in the securing position, the at least one support structure engaging the exterior surface of the at least one conductor to thereby provide a clamping fit between the at least one support structure and the at least one conductor positioned in the at least one oblong hole when the at least one support structure is in the securing position to thereby maintain the position of and secure the at least one conductor within the enclosure.

4. A method of manufacturing a signal coupling device, which comprises the steps of:

inserting at least first and second conductors capable of carrying signals respectively through at least first and second oblong holes formed through the thickness of at least one support structure, the at least first and second oblong holes being spaced apart from each other by a predetermined distance so that the at least first and second conductors received by the at least first and second oblong holes are maintained at a predetermined spacing from each other to effect a desired coupling of signals from one of the at least first and second conductors to the other of the at least first and second conductors, each of the at least first and second oblong holes being defined by a major axis and a minor axis disposed perpendicularly to the major axis, each of the at least first and second oblong holes being formed with a greater length along the major axis than along the minor axis, the at least one support structure having opposite inner edges defining the length of each of the at least first and second oblong holes along the major axis thereof, the at least first and second conductors being slidably receivable respectively by the at least first and second oblong holes while the at least one support structure is in an assembling position, each of the at least first and second conductors having a longitudinal axis and an external surface;

placing into an enclosure the at least one support structure and the at least first and second conductors respectively positioned in the at least first and second oblong holes of the at least one support structure, the enclosure having a main body portion defining a cavity into which the at least one support structure and the at least first and second conductors are placed, the enclosure further including a removable cover securable to the main body portion; and contacting the at least one support structure with the cover when the cover is secured to the main body portion of the enclosure, the cover exerting a force on the at least one support structure to reposition the at least one support structure from the assembling position to a securing position, the at least one support structure being at an angle greater than 0 degrees to a normal to the longitudinal axis of the at least first and second conductors when the at least one support structure is in the securing position, the at least one support structure engaging the exterior surfaces of the at least first and second conductors at the opposite inner edges defining the at least first and second oblong holes of the at least one support structure when the at least one support structure is in the securing position, the at least one support structure providing a clamping fit between the at least one support structure and the at least first and second conductors respectively positioned in the at least first and second oblong holes when the at least one support structure is in the securing position to thereby maintain the relative positions of the at least first and second conductors within the enclosure when the cover is secured thereto.

5. A method of manufacturing a signal coupling device as defined by claim 4, which further comprises the steps of:

forming the at least one support structure with a length such that the at least one support structure extends partially out of the cavity defined by the main body portion of the enclosure when the at least one support structure is in the assembling position and is placed with the at least first and second conductors in the cavity of the enclosure; and securing the cover to the main body portion of the enclosure such that the cover engages at least a portion of the at least one support structure extending partially from the cavity so that the cover exerts a force on the at least one support structure and positions the at least one support structure in the securing position.

6. A method of manufacturing a signal coupling device, which comprises the steps of:

inserting at least first and second conductors capable of carrying signals respectively through at least first and second oblong holes formed through the thickness of at least one support structure, the at least first and second oblong holes being spaced apart from each other by a predetermined distance so that the at least first and second conductors received by the at least first and second oblong holes are maintained at a predetermined spacing from each other to effect a desired coupling of signals from one of the at least first and second conductors to the other of the at least first and second conductors, each of the at least first and second oblong holes being defined by a major axis and a minor axis disposed perpendicularly to the major axis, each of the at least first and second oblong holes being formed with a greater length along the major axis that along the minor axis, the at least first and second oblong holes along the major axis thereof, the at least first and second conductors being slideably receivable respectively by the at least first and second oblong holes while the at least one support structure is in an assembling position, each of the at least first and second conductors having a longitudinal axis and an external surface;

placing into an enclosure the at least one support structure and the at least first and second conductors respectively positioned in the at least first and second oblong holes of the at least one support structure, the enclosure having a main body portion defining a cavity into which the at least one support structure and the at least first and second conductors are placed, the enclosure further including a removable cover securable to the main body portion;

contacting the at least one support structure with the cover when the cover is secured to the main body portion of the enclosure, the cover exerting a force on the at least one support structure to reposition the at least one support structure from the assembling position to a securing position, the at least one support structure being at an angle greater than 0 degrees to a normal to the longitudinal axis of the at least first and second conductors when the at least one support structure is in the securing position, the at least one support structure engaging the exterior surfaces of the at least first and second conductors at the opposite inner edges defining the at least first and second oblong holes of the at least one support structure when the at least one support structure is in the securing position, the at least one support structure providing a clamping fit between the at least one support structure and the at least first and second conductors respectively positioned in the at least first and second oblong holes when the at least one support structure is in the securing position to thereby maintain the relative positions of the at least first and second conductors within the enclosure when the cover is secured thereto;

forming the at least one support structure with a length such that the at least one support structure extends partially out of the cavity defined by the main body portion of the enclosure when the at least one support structure is in the assembling position and is placed with the at least first and second conductors in the cavity of the enclosure; and securing the cover to the main body portion of the enclosure such that the cover engages at least a portion of the at least one support structure extending partially from the cavity so that the cover exerts a force on the at least one support structure and positions the at least one support structure in the securing position.

7. A radio frequency, millimeter-wave or microwave device, which comprises:

an enclosure;

at least one support structure, the at least one support structure being disposed within the enclosure, the at least one support structure having at least one oblong hole formed through the thickness thereof; and at least one conductor, the at least one conductor being disposed within the enclosure and being received by the at least one oblong hole of the at least one support structure, the at least one support structure securing the at least one conductor in place within the enclosure, the at least one conductor being manufactured from copper rod.

8. A radio frequency, millimeter-wave or microwave device, which comprises:

an enclosure;

at least one support structure, the at least one support structure being disposed within the enclosure, the at least one support structure having at least one oblong hole formed through the thickness thereof; and at least one conductor, the at least one conductor being disposed within the enclosure and being received by the at least one oblong hole of the at least one support structure, the at least one support structure securing the at least one conductor in place within the enclosure, the enclosure engaging the at least one support structure and exerting a force thereon to secure the at least one support structure within the enclosure, the at least one support structure having opposite outer peripheral edges, the enclosure engaging and deforming the opposite outer peripheral edges of the at least one support structure.

* * * * *